US005415372A

United States Patent [19]

Shepherd et al.

[11] Patent Number: 5,415,372

[45] Date of Patent: May 16, 1995

[54] SELF CLOSING COVER AND MOUNTING ASSEMBLY FOR TELEPHONE DIRECTORY

[76] Inventors: Charles G. Shepherd, P.O. Box 64, Oakville, Ontario, Canada, L6J 4Z5; David R. Chapman, 145 Wynchwood Place, London, Ontario, Canada, N6G 1S7

[21] Appl. No.: 31,971

[22] Filed: Mar. 16, 1993

[51] Int. Cl.[6] ..... A47B 97/04

[52] U.S. Cl. ..... 248/447; 281/45; 281/43

[58] Field of Search ..... 248/447, 451; 281/45, 281/43; 312/233

[56] References Cited

U.S. PATENT DOCUMENTS

| | | | |
|---|---|---|---|
| 272,008 | 2/1883 | Work | 248/447 |
| 421,267 | 2/1890 | Glover | 248/447 |
| 440,816 | 11/1890 | Noyes | 248/447 |
| 546,479 | 9/1895 | Whipple | 248/447 |
| 949,054 | 2/1910 | Benjamin | 248/447 |
| 1,021,614 | 3/1912 | Lundius | 248/447 |
| 1,039,296 | 9/1912 | Krumming | 281/45 |
| 1,117,072 | 11/1914 | Lundius | 248/447 |
| 1,334,020 | 3/1920 | Davison | 248/447 |
| 1,674,975 | 6/1928 | Lundius | 248/447 |
| 3,967,807 | 7/1976 | Claxton | 248/447 |

*Primary Examiner*—Ramon O. Ramirez
*Assistant Examiner*—Korie H. Chan

[57] ABSTRACT

A book cover assembly has a book, a cover and a retainer securing the book to the cover. Pivot members associated with either mounting means for securing the cover to a fixed structure or the cover are biased to pivot to a position associated with the cover in a closed configuration by biasing means associated with the other of said mounting means and cover. The biasing means engage the pivot members under urging from the book as it falls from an open upper position.

The mounting assembly is disposed at 45° to the spine of the book cover assembly and is hinged at 45° to a mounting plate so that the book can be moved from a preferred stored orientation which is side face-out to a conventional open orientation with the spine at 90° to its original position. A variation for accommodating a pair of books in tandem is also described in which the books will locate in a preferred orientation.

10 Claims, 9 Drawing Sheets

SELF CLOSING COVER AND MOUNTING ASSEMBLY FOR TELEPHONE DIRECTORY

FIELD OF THE INVENTION

This invention relates to a book cover of the kind which is used to protect a telephone directory in public places where it may be exposed to weathering and vandalism. It will be understood that the book cover may be useful to protect other types of books of this nature used predominantly in public environments. The invention will however be described with reference to a telephone directory which is envisaged to be the most common use for the cover.

BACKGROUND OF THE INVENTION

One problem which arises with the use of public telephone directories is their unauthorized removal from designated locations. To address this problem, telephone book covers have been developed which provide means to securely attach the directory to the cover which in turn is secured to a shelf or desk. Exemplary means of the kind used to secure the directory to the cover are described in U.S. Pat. No. 4,561,623 Shepherd et. al. and this disclosure is incorporated herein by reference.

Another problem is exposure of a book used in outdoor environments to weathering elements such as wind, rain and snow. This has been addressed in part by providing a cover which in effect houses the directory on all sides and is adapted to deflect precipitation away from the interior of the cover and thereby maintain the directory in good condition with a minimum of replacement being required. A book cover of this nature is disclosed in U.S. Pat. No. D310,099 Chapman et. al. and its disclosure is also incorporated herein by reference.

One of the problems addressed by this invention is how to maintain the cover in a closed configuration when it is not in use so that any ingress of precipitation into the cover interior is further minimized.

Another problem addressed by this invention is that of securing the book cover to a shelf or the like so as to make it vandalproof and still another problem relates to efficiently using the available space to make one or more directories conveniently accessible to the user from a stored position known as side face-out. In some prior art devices, the directories are deployed from a side face-out orientation to an off-centre position which effectively increases the operating space required by 50%. This is clearly undesirable and in locations where space is a premium, such devices are impossible to use.

Yet another problem in the storage of more than one directory on a carousel-type mount is that the directories are sometimes left in random positions which gives the telephone booth a cluttered and untidy appearance.

SUMARY OF THE INVENTION

The object of this invention is to address at least one of the aforementioned problems.

In accordance with this invention, a book cover assembly having a book, a cover, and a retainer for attaching the book to the cover has closing means for the cover having pivot members which move between a closed position associated with the cover in a closed configuration and an open position angularly spaced from the closed position with the cover in an open configuration. Such movement to the closed position by the pivoted members is brought about by biasing means engaging the pivoted members when the book is released from an upper position with the cover open and the book is in use to a lower position where the book is stored and is accelerated by gravity.

In a preferred embodiment, the closing means is disposed between the book cover and a housing fixed to the book cover assembly. The housing and the book cover are movable relative to a mounting assembly for securing the book cover assembly to a fixed structure and during storage of the book, the housing engages bail members attached to the mounting assembly so as to bias the bail members to pivot toward the cover and close the cover.

In a variation, the pivoted members form part of the book cover and the biasing means are attached to the mounting assembly.

In accordance with another aspect of the invention, there is provided mounting means for the book cover assembly comprising a supporting member coupled to the book cover assembly and disposed at a first angle transverse to the spine of the cover. The supporting member is hinged to a mounting plate with hinge means disposed at a second angle transverse to the spine which is the complement of said first angle. In a preferred embodiment, said first and second angles are both 45°. In this way, the book may be deployed from a stored position to a configuration which is transverse to a starting position upon raising the book cover assembly and pivoting the book cover assembly about the mounting plate.

In accordance with a variant of the invention, the mounting means accommodates a pair of book cover assemblies in tandem, and the supporting members are hinged to a pivot plate rotatably coupled to the mounting plate. Locating detents on a tubular projection which receives a post coupled to the mounting plate are defined at the apex of cam contours which urge the book covers into pre-determined starting positions corresponding to a preferred orientation of the books relative to a fixed structure.

BRIEF DESCRIPTION OF THE DRAWINGS

A preferred embodiment of the invention is described below with reference to the accompanying drawings in which.

DESCRIPTION OF PREFERRED EMBODIMENT WITH REFERENCE TO THE DRAWINGS

Figure 1:
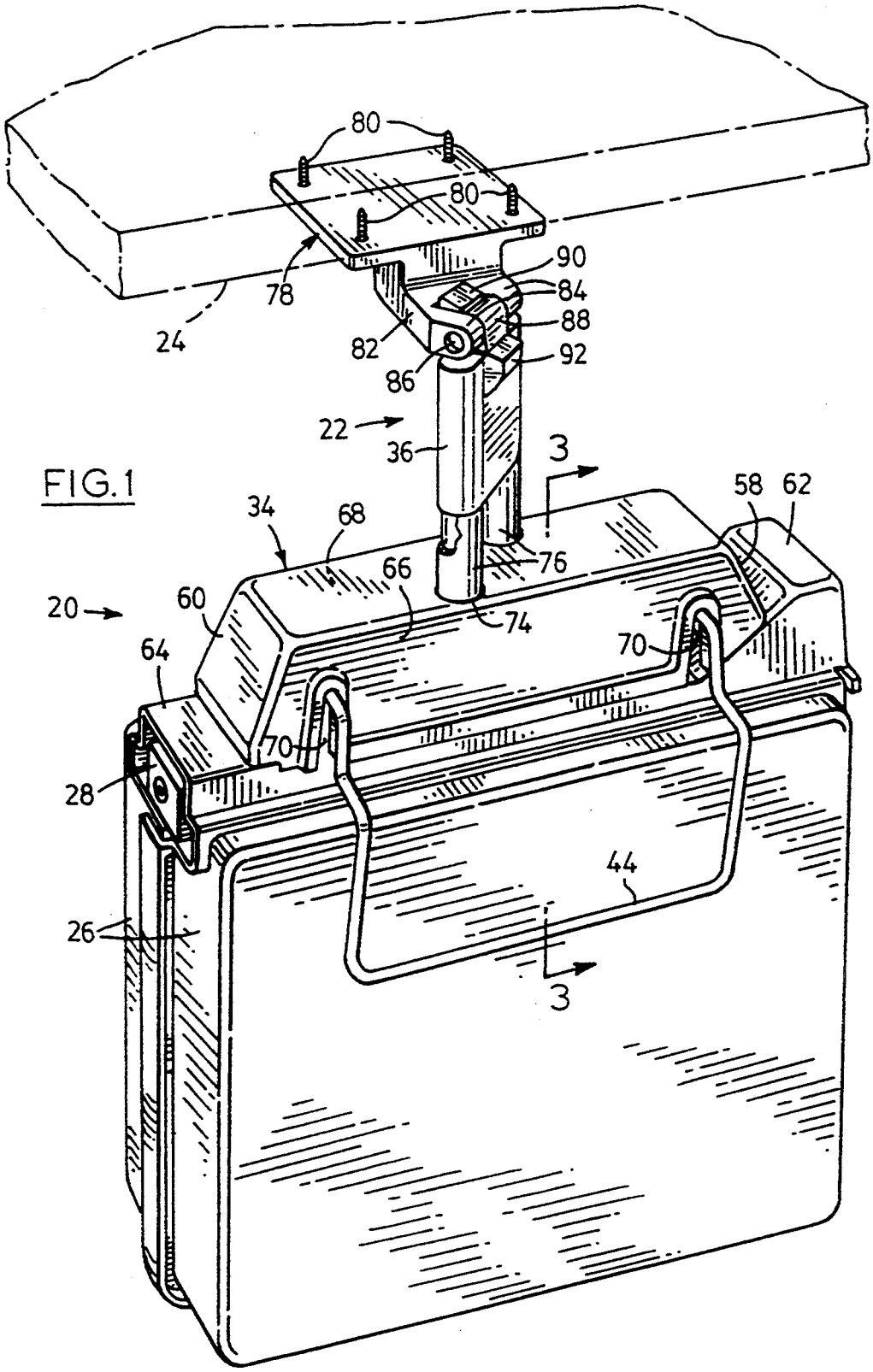
FIG. 1 is a perspective view from the front of a telephone cover assembly mounted to a shelf (drawn in chain dotted outline) and ready for use.

Referring to FIG. 1, a telephone book cover assembly according to the invention is generally indicated by reference numeral 20 in association with a mounting assembly 22 made according to the invention and secured to a shelf 24 shown in chain dotted outline. It will be seen that the cover assembly 20 is oriented with its spine parallel to the shelf 24 such that the ends face away from the user. This is known in the industry as a "side face-out" configuration.

Figure 2:
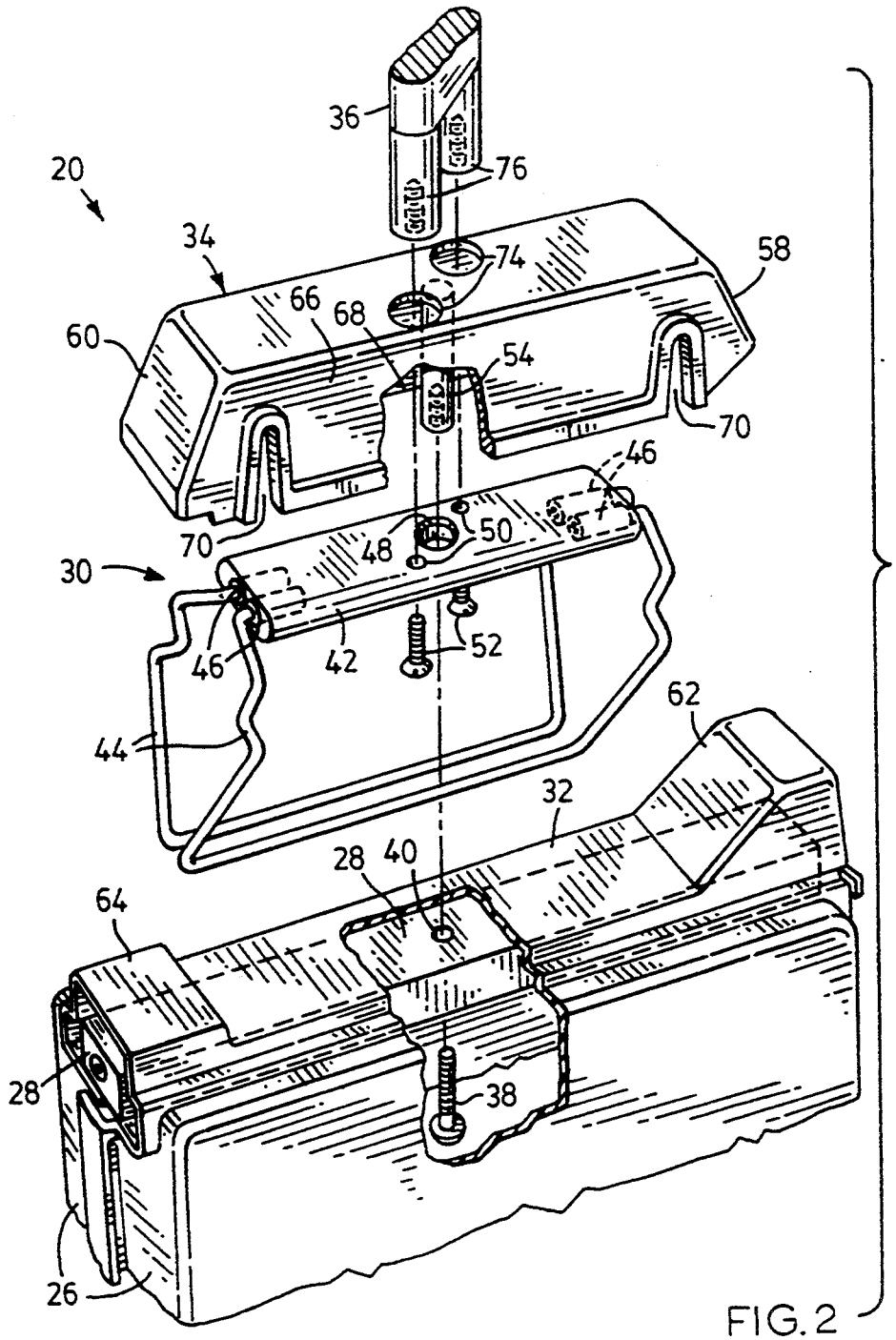
FIG. 2 is an exploded view showing the component parts of the assembly of FIG. 1.

The component parts comprising the book cover assembly 20 are more clearly shown in FIG. 2 and include a molded plastic cover 26 with associated metal directory retainer 28; a bail assembly 30 which in use is disposed over the spine 32 of the plastic molded cover 26; and a housing 34. A yoke 36 forming part of the mounting assembly 22 completes the book cover assembly.

A description of an exemplary directory retainer 28 may be found in U.S. Pat. No. 4,561,623 Shepherd et. al. and this disclosure is as, mentioned above, incorporated herein by reference. In this invention, the spine 32 of the molded cover 26 is apertured to receive a bolt 38 which traverses the metal directory retainer 28 through a corresponding hole 40 so as to locate the head of the bolt 38 on the underside of the metal directory retainer 28 with the threaded end of the bolt extending outwardly from the cover.

The bail assembly 30 comprises an aluminum bar 42 having rounded edges along its sides and two pairs of blind holes each machined on opposite ends of the bar 42 and receiving respective ends of a bail 44. Preferably, a bail 44 will be constructed from a steel rod and bent to the required shape so that an end remote from the pivoted end will abut on the cover 26 in the closed configuration. The bails 44 are provided in pairs and in use are disposed to lie on opposite sides of the plastic molded cover 26. It will be noted that the pivoted ends of the bails are covered with a plastic sleeve 46 shown in chain dotted outline so as to facilitate rotation of the bails 44 inside the bar 42. The bar 42 also has a central aperture for receiving the bolt 38 and two further apertures 50 disposed on opposite sides of the aperture 48 for receiving respective screws 52.

The housing 34 is cast aluminum which rests over the spine 32 of the plastic molded cover 26 and is secured to the cover with the bolt 38 which is threaded into a post 54. In FIG. 2, the housing 34 has been partly broken away to show the post 54 which extends downwardly from a top wall 56 of the housing 34 and has a threaded blind hole for receiving the bolt 38.

End walls 58, 60 of the housing 34 are shaped to co-operate and mate with abutments 62, 64 molded into the spine 32 of the plastic molded cover and combine with side walls 66, 68 to cover the bail assembly 30. A pair of downwardly extending slots 70, 72 (FIGS. 3,5) disposed on opposite sides 66,68 respectively of the housing 34 are spaced from each other and dimensioned so as to accommodate the bails 44.

The top wall 56 of the housing 34 has a pair of holes 74 disposed at 45° to the axis of the spine 32 on opposite sides of the post 54. The holes 74 receive therethrough a pair of posts 76 extending downwardly from the yoke 36 comprising the mounting assembly 22. Each post 76 has a threaded blind hole for receiving the screws 52 which join the bail assembly 30 to the yoke 36 so as to form a unitary body. One of the posts 76 is drawn partly broken away in FIG. 1 showing that it is covered by a plastic sleeve which facilitates relative motion between the housing 34 and the yoke 36.

The mounting assembly 22 will now be described with particular reference being made to FIG. 1. In addition to the yoke 36, the mounting assembly 22 comprises a mounting plate 78 which is secured to the underside of the shelf 24 with a plurality of screws 80. A tongue 82 is cast into the mounting plate 78 and extends outwardly from the shelf to terminate in a pair of hinge members 84 disposed at 45° to the shelf 24 and receiving therethrough a hinge pin 86 for hingedly connecting to the yoke 36.

The yoke 36 has a complementary hinge member 88 dimensioned to be received between the hinge members 84 of the mounting plate 78 and receive therethrough the hinge pin 86. A pair of stops 90 cast into opposite sides of the tongue 82 operate to arrest pivotal movement of the yoke 36 towards the shelf 24 and away therefrom. A boss 92 cast into one side of the yoke 36 is adapted to mate with the associated stop 90 on the mounting plate 78 and operates to arrest such pivotal motion of the yoke and the associated book cover assembly 20 so that its centre of gravity never lies on the opposite side of the hinge pin 86 and the book cover will naturally fall into the suspended configuration illustrated in FIG. 1.

Figure 4:
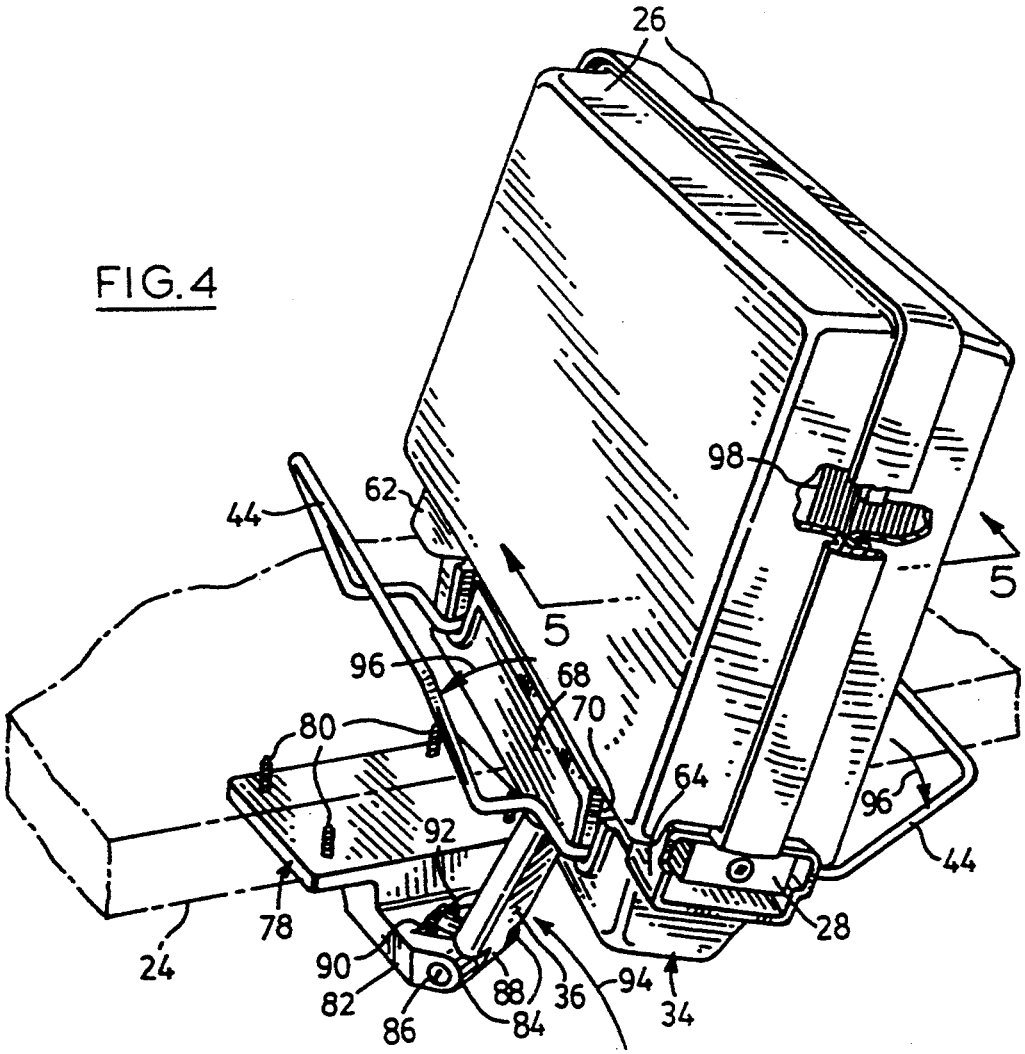
FIG. 4 is a perspective view (drawn to a smaller scale) showing the book cover pivoted upwardly for deployment in an open configuration over the associated shelf.

It will be understood that the mounting assembly 22 and in particular the angular orientation of the hinge members 84 of the mounting plate 78 and the complementary angular orientation of the posts 76 of the yoke 36 allow for the book cover assembly 20 to be stored in the side face out orientation illustrated in FIG. I and to be deployed to a configuration which is transverse to said starting position and in particular, in this embodiment, orthogonal thereto. The side face-out orientation minimizes the depth of space occupied by the directory thereby freeing up valuable floor space to an occupant of the telephone booth. The mounting assembly 22 also permits the molded cover 26 to be raised as indicated by arrow 94 in FIG. 4 and opened as indicated by arrows 96 in FIG. 5 to a configuration in which the spine 32 is approximately orthogonal to the shelf 24 thereby allowing the user to access a directory 98 in a conventional orientation.

Figure 5:
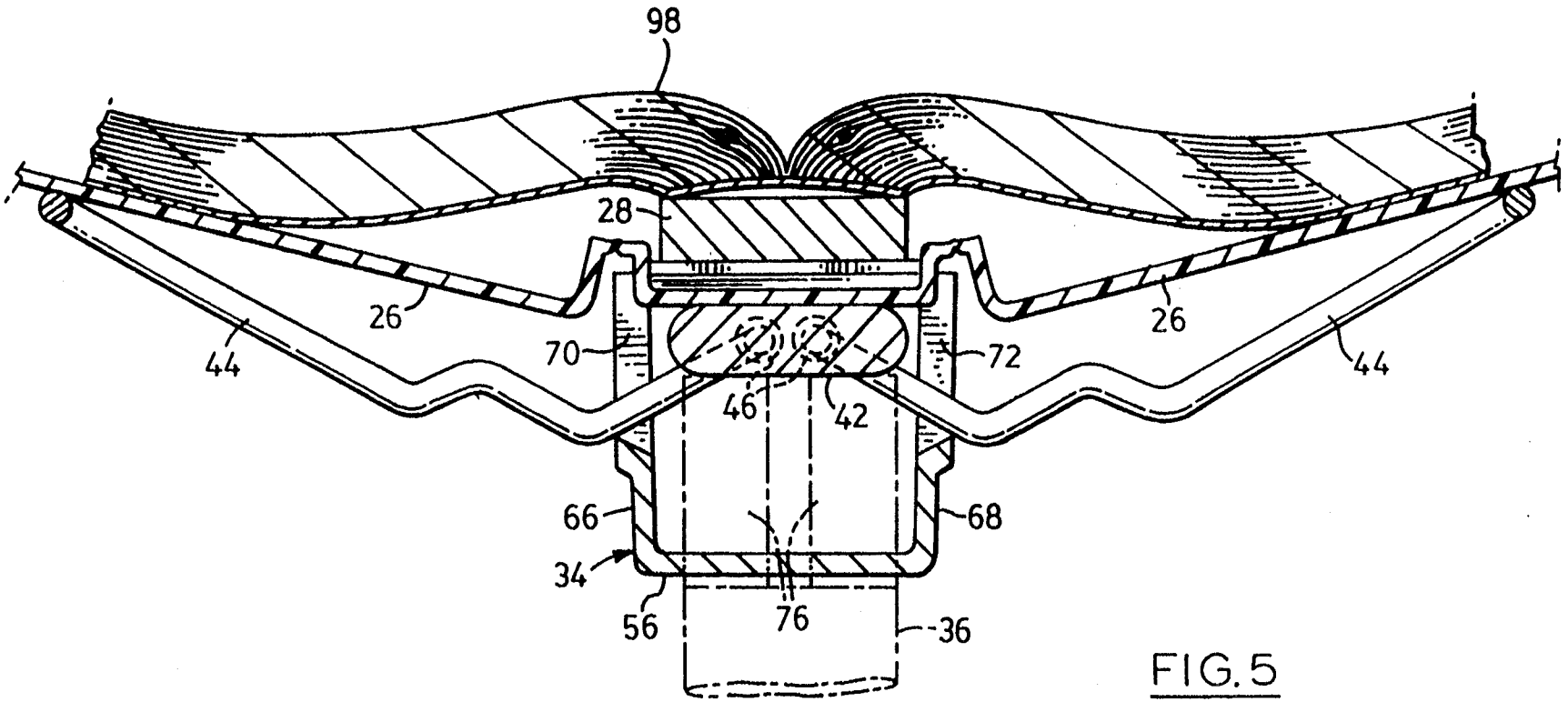
FIG. 5 is a cross-sectional view taken on line 5—5 of FIG. 4 with the book assembly deployed in said open configuration.
Figure 6:
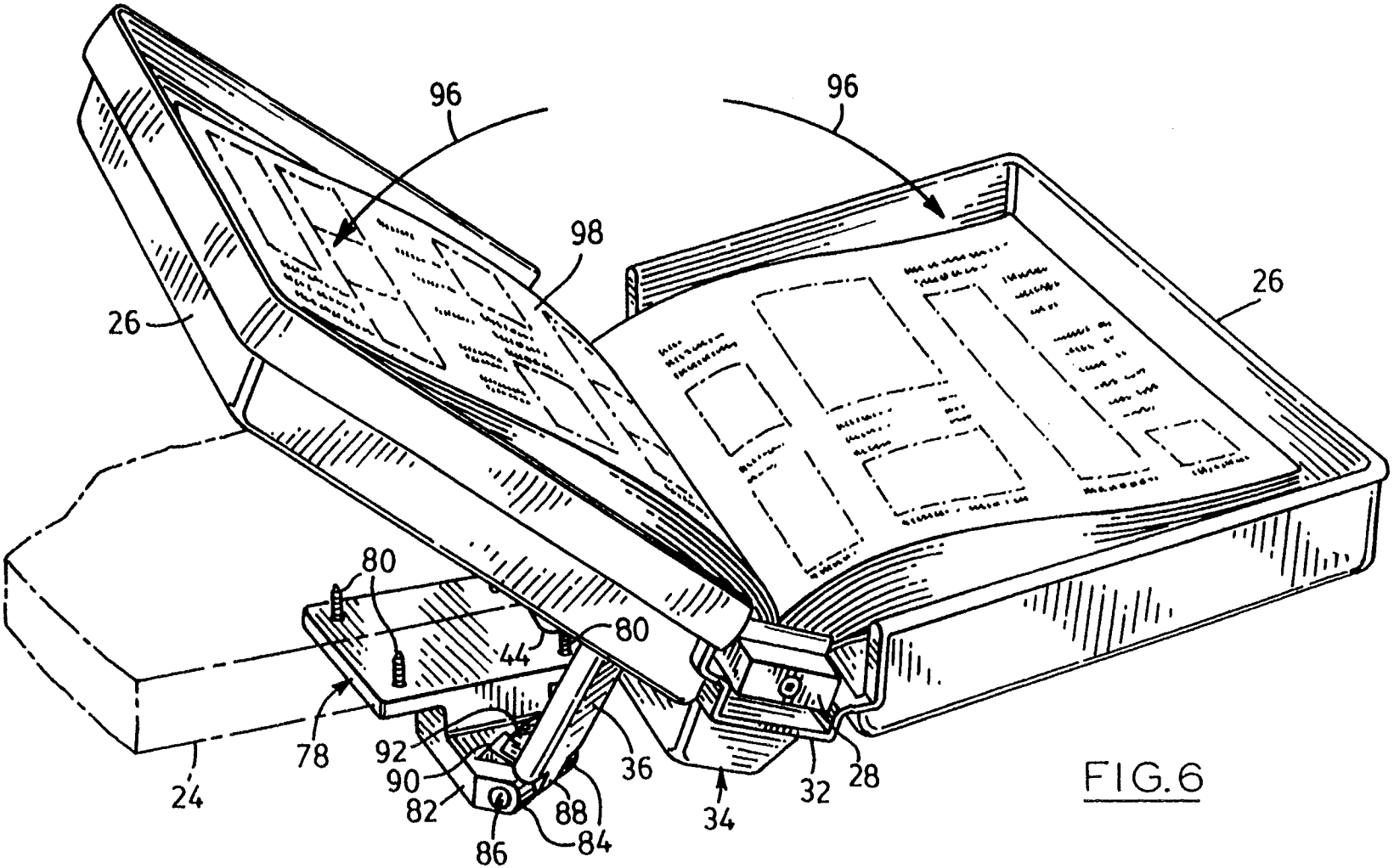
FIG. 6 is a perspective view showing the book in said open configuration.

It will be appreciated that a small pressure will be applied by the user to the telephone directory 98 to maintain it in the open configuration shown in FIG. 5 as otherwise it will fall to the aforementioned suspended configuration drawn in FIG. 1.

Figure 3:
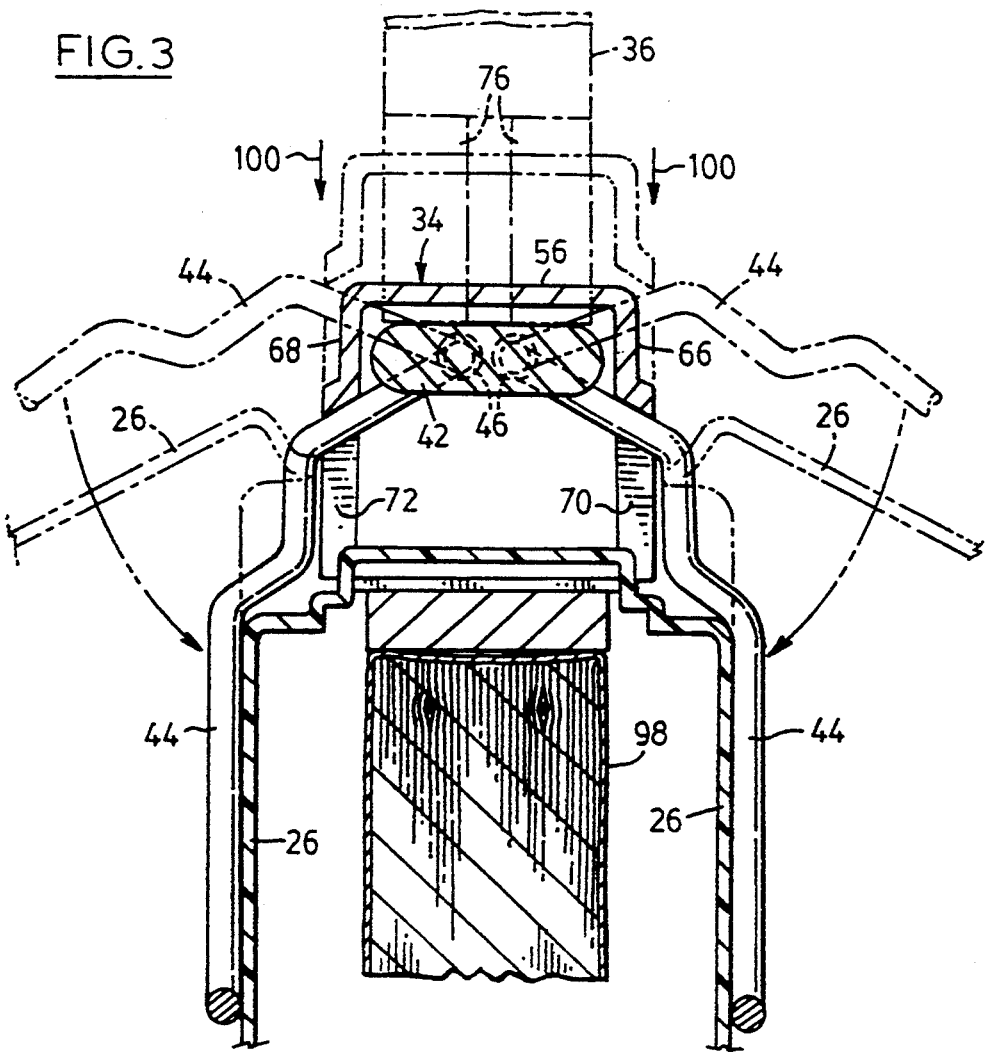
FIG. 3 is a cross-sectional view taken on line 3—3 of FIG. 1 and showing in chain dotted outline the configuration of the book cover when it is in an intermediary position prior to closing.

In the transition between the open configuration of FIG. 5 and the closed configuration of FIG. 1, the mass of the directory 98 will pull on the housing 34 so that it slides downwardly on the posts 76 of the yoke 36 as indicated by arrows 100 in FIG. 3 and engages the bails 44 of the bail assembly 30 naturally accelerated by gravity. As indicated by arrows 102, the bails 44 will pivot downwardly and engage the sides of the cover 26 thereby urging them towards each other in a closed configuration.

The heavier the directory 98, the greater will be the force pulling the housing 34 which in turn is applied to the bail members 44. The invention thus provides an elegant means of self-closing a book cover in which the degree of force applied to the book cover is determined by the mass of the directory contained therein.

It will be appreciated that the relative angle between the pivoted ends of the bails 44 and the ends abutting the cover 26 is selected to allow the bails to move from a closed position where they rest against the surface of the plastic molded cover 26 (FIG. 3) to an open position where they are sufficiently spaced from each other (FIG. 5) to accommodate an open directory therebetween.

The height of the side walls 66, 68 of the housing 34 above the slots 70, 72 is selected to allow the associated directory to move between the closed and opened configurations without the housing abutting on the bar 42 while the length of the slots or remaining wall height is sufficient to hide the bar 42 even when the directory is deployed and the housing has reached its maximum displacement away from the bar 42.

The vertical distance travelled by the housing 34 on the yoke 36 is determined by the angular displacement of the bails 44 between said open and closed configurations of the cover and the posts 76 of the yoke will have a length commensurate with the distance travelled by the housing and the additional height required to allow the housing to clear the bar 42 and the yoke 36.

Figure 7:
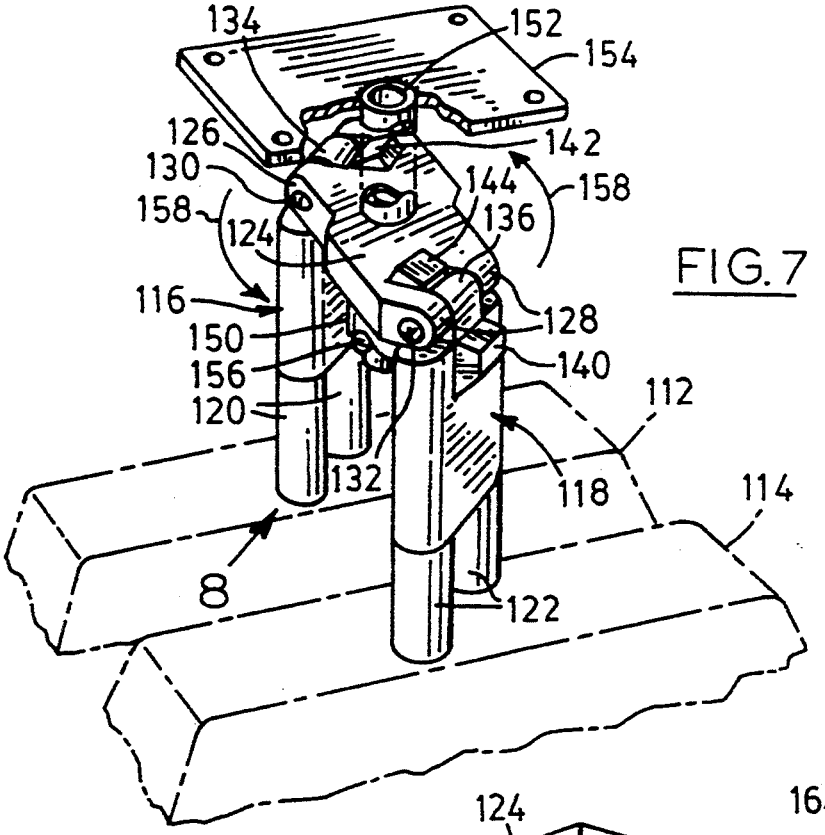
FIG. 7 is a perspective view showing an alternative mounting assembly for supporting a pair of directories in tandem fashion beneath a shelf (not shown)

An alternative embodiment of the mounting assembly is shown in FIG. 7 and generally indicated by reference numeral 110. This mounting assembly 110 is adapted to support in tandem a pair of directory cover assemblies 112,114 in a side face-out orientation, that is with the spines parallel to each other and disposed parallel to an associated shelf (not shown) so as to minimize the depth of space occupied by the directories in a telephone booth.

Each directory cover assembly 112,114 is secured to a respective yoke 116,118 similar in configuration to the yoke 36 of the embodiment described above with reference to FIGS. 1 through 6. The yokes 116, 118 each comprise a respective pair of posts 120,122 which are oriented in parallel to each other and at 45° to the spine of the respectively associated directory cover assembly.

A single pivot arm 124 joins the yokes 116,118 and comprises a plate which terminates at opposite ends in two pairs of hinge members 126,128 respectively associated with the yokes 116,118. The hinge members 126,128 are aperture to receive respective hinge pins 130, 132 and are disposed to lie in parallel to each other with the pins at 45° to the spine of the associated directory cover assemblies 112,114 The yokes 114 118 have respective hinge members 134,136 adapted to be received between the hinge members 126,128 of the pivot arm 124 and to receive therethrough the respective hinge pins 130,132.

Each yoke 116,118 also has a respective boss 138 (not shown), 140 which in use will arrest continued pivotal motion about the associated pins 130,132 so that the associated assembly will come to rest on stops 142, 144 cast into the pivot arm 124. Another pair of bosses 146, 148 on the opposite side of the pivot arm 124 operate to arrest continued pivotal motion of the yokes 116,118 in the opposite direction.

A tubular projection 150 (FIG. 8) centrally disposed between the pivot members 126,128 extends downwardly a short distance from the underside of the pivot arm 124. The tubular projection 150 is rotatable about a post 152 connected to the underside of a mounting plate 154 which is apertured for receiving screws to secure it to the underside of a counter or shelf (not shown). At the other end, the post 152 has a pair of outwardly extending lands 156 defined by a transversly extending pin which locate in respective co-operating detents 158 defined at the apex of cam contours machined into the bottom surface of the tubular projection 150.

In use, any one of the directories in the directory cover assemblies 112,114 may be selected by rotating the pivot arm 124 about the post 152 as indicated by arrows 158 so as to bring the selected directory closer to the user. The lands 156, and detents 158 cooperate to positively locate the selected directory in the required orientation so that it may then be deployed by pivoting the associated yoke 116,118 about the respective associated hinge pin 130, 132 to bring the directory face upward with its spine disposed substantially orthogonally to the shelf in conventional manner.

Furthermore, any rotation of the pivot arm 124 will position the directories in a side face-out orientation under urging of the cam contours at the bottom of the tubular projection 150. The telephone booth would therefore always have a desirably neat and tidy appearance.

It will be noted that the tubular projection 150 climbs up the post 152 as it rides over the lands 156. The post 152 is accordingly made to a length sufficient to accommodate the vertical displacement of the tubular projection 150 which occurs on rotation about the post.

Figure 8:
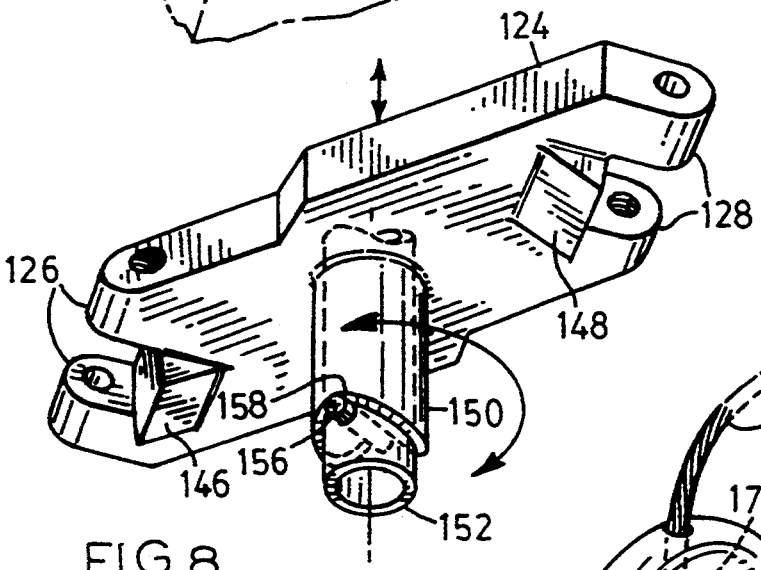
FIG. 8 is a detailed perspective view taken on arrow 8 of FIG. 7 showing a pivot arm forming part of the mounting assembly.

The tandem arrangement shown in FIGS. 7 and 8 allows the book cover assemblies to be mounted to the centre of an associated shelf and likewise to be deployed over the mounting plate 154 so that the associated telephone directory is also centered when it is in its open configuration. In prior art book assemblies hinged at the spine and stored in a side face-out orientation, the assemblies must be rotated in tandem at the spine through 90° before being individually deployed, resulting in an off-centre position and effectively increasing the operating space required to comfortably use the book by 50%. This is clearly undesirable and in locations where space is a premium such assemblies are indeed virtually impossible to use.

Figure 9:
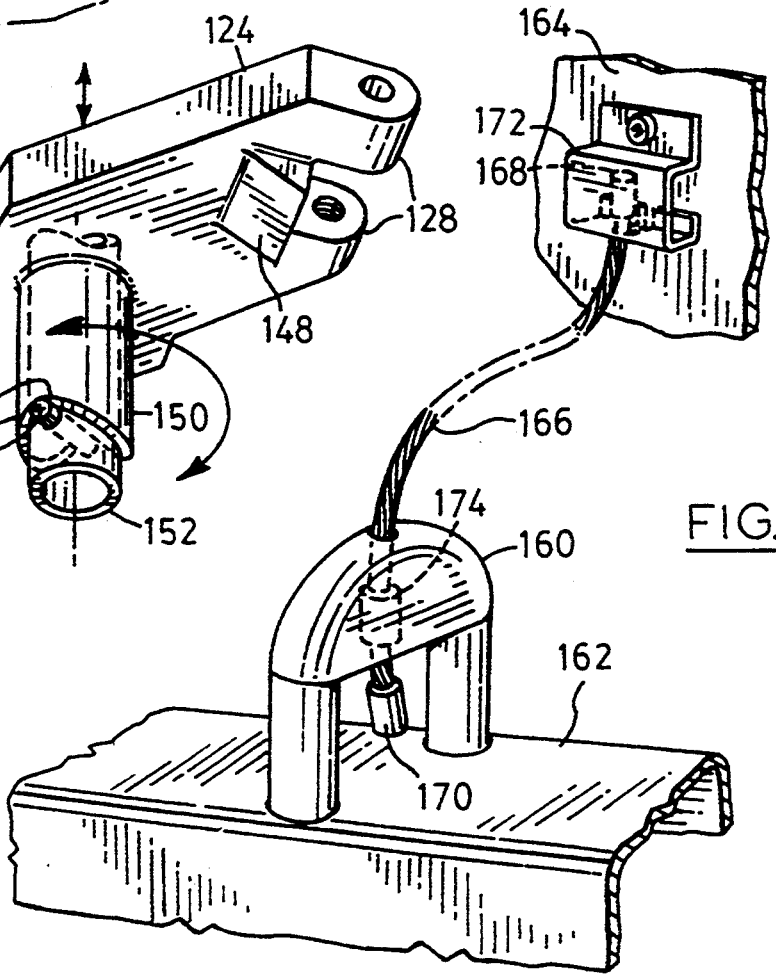
FIG. 9 is a perspective view showing yet another alternative mounting assembly which may be used in association with the book cover drawn in Figs. 1, to 6.

Finally, it will be appreciated that any mounting assembly may be used with the self closing feature of the invention provided by the combination of the yoke, housing and bail assembly. Accordingly, an exemplary embodiment of a conventional mounting assembly is shown in FIG. 9 where 10 the yoke 160 and associated book cover assembly 162 are attached to a wall 164 by means of a lanyard 166 terminating in swaged ends 168,170 and retained in a suitable wall bracket 72 at one end and in a suitable socket 174 formed into the yoke 160 at the other end.

Several variations may be made to the invention within the scope of the appended claims.

In the case of the mounting assembly, it will be appreciated that the angular displacement of the hince and of the supporting member or yoke relative to the spine of the book will be determined by the preferred orientation of the book cover assembly in both the stored configuration and the deployed configuration. The total angular displacement from the stored configuration to the deployed configuration is preferably 90° but is not limited thereto. Furthermore, the angular displacement of the hinge and of the supporting member relative to the yoke may be any two complementary angles and will be selected according to the physical limitations of the site where the directory is installed.

It will also be understood that the closing means for the book cover may comprise a pivot member associated with the book cover, in which case means to bias the pivot member to a first position associated with the cover in a closed configuration of the cover will be associated with the mounting means.

Figure 11:
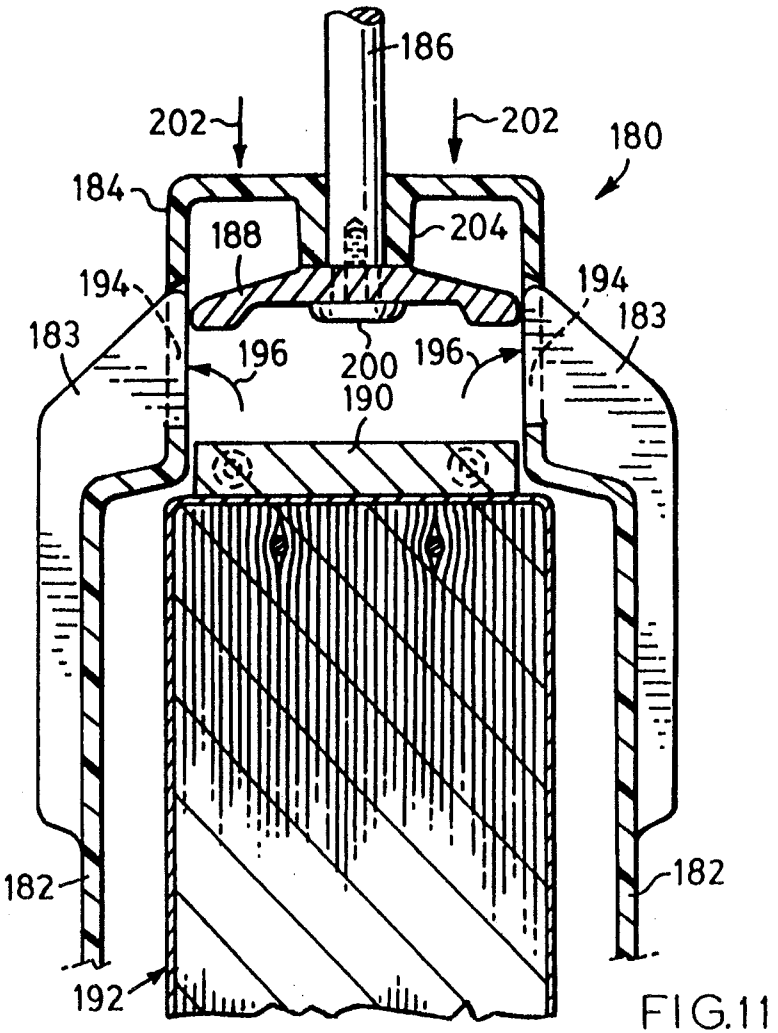
FIG. 11 is a cross-sectional view taken on line 11—11 of FIG. 10 and similar to FIG. 3.
Figure 10:
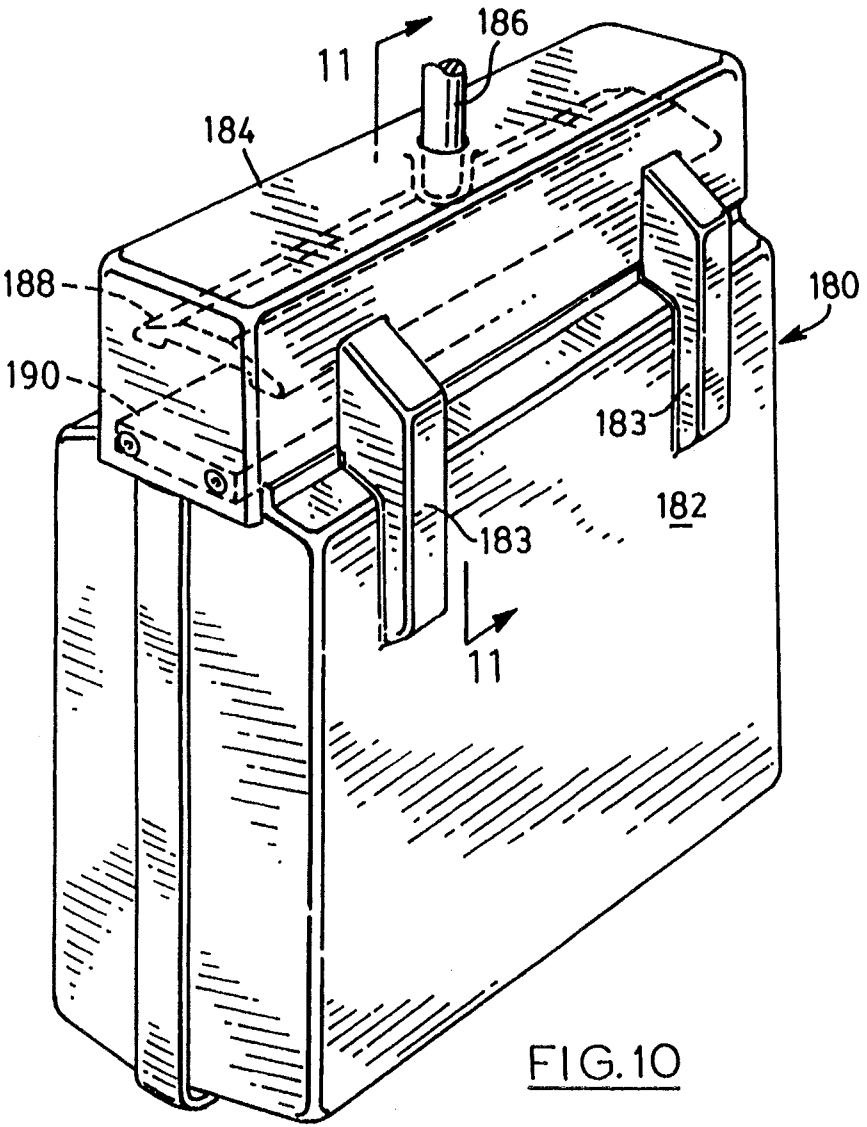
FIG. 10 is a perspective view similar to FIG. 1 and showing an alternative closing means in accordance with the invention.
Figure 12:
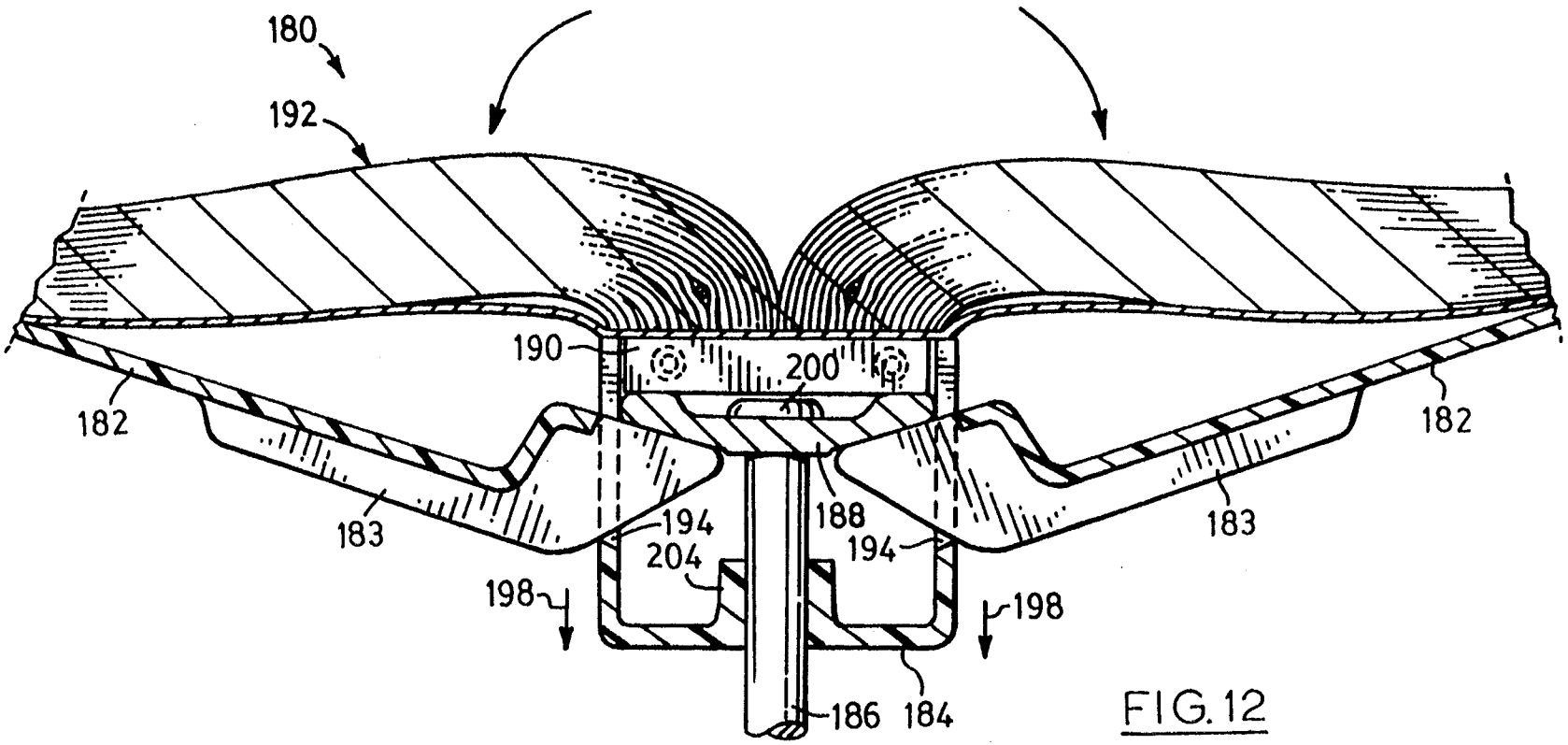
FIG. 12 is a sectional view similar to FIG. 5 showing the book of FIG. 11 in a deployed orientation.

An exemplary embodiment is drawn in FIGS. 10–12 where a book assembly according to the invention is generally designed by numeral 180 and includes the following components: a book cover 182 having integrally molded ribs 183 adjacent the spine; a housing 184 disposed on the spine of the cover 182 and molded with the cover; a support member 186 in the form of a rod slidably received in the housing 184 and attached to a fixed structure (not shown); a bar 188 received in the housing and attached to the support member 186, the bar in this case extending along the length of the spine; and a retainer 190 for attaching a book 192 (FIG. 11,12) to the cover 182.

The housing 184 and the cover 182 are joined by a "living hinge" at the spine and the housing 184 has two pairs of oppositely openings 194 longitudinally spaced from each other along the spine. The ribs 183 are likewise provided in oppositely disposed pairs longitudinally spaced from each other along the spine and are positioned to be received in said openings 194.

Upon pivoting the cover 182 about said living hinge at the housing 184, the ribs 183 penetrate the housing as shown in FIG. 12.

The bar 188 is shaped and dimensioned so that it will lie in the path of pivotal motion of the ribs 183 indicated by arrows 196 in FIG. 11.

Thus when the book 192 is deployed from its suspended configuration shown in FIGS. 10 and 11, and brought to the configuration shown in FIG. 12, the support member 186 being flexibly mounted or hinged to allow it to be flipped upwardly, the book cover housing 184 will slide on the support member 186 as indicated by arrows 198 in FIG. 12 until the retainer 190 engages the bar 188. It will be noted that the bar 188 is recessed to accommodate a fastener 200 securing it to the support member 186. The cover 182 will pivot at the housing 184 and carry with it, the ribs 183 which will penetrate the housing and abut the bar 188.

Upon releasing the book for suspension in the stored position, the housing 184 will slide downwardly relative to the support member 186 as indicated by arrows 202 drawn in FIG. 11 until a stop 204 molded about an opening for receiving the support member 186 engages the bar 188. During such downward motion (as drawn) of the housing 184 promoted by the invention of the book 192, the ribs 183 will be biased by the bar 188 to pivot in the direction indicated by arrows 196 and thereby close the cover 182.

Still other variations to the above described embodiments will be apparent to those skilled in the art.

We claim:

1. Book cover assembly comprising a cover having a spine and a retainer for attaching a book to the cover;

mounting means for securing the cover by the spine to a fixed structure, the mounting means being disposed on at least one axis transverse to a plane containing said spine and the cover being relatively movable to said mounting means on one said transverse axis between an upper position and a lower position;

and self closing means comprising at least one pivot member associated with either of said mounting means and the cover, and pivotable between a closed position associated with the cover in a closed configuration and an open position angularly spaced from the closed position with the cover in an open configuration;

and biasing means associated with the other of said mounting means and the cover, said biasing means and pivot member being adapted to engage one another upon relative movement between the cover and the mounting means as the book and cover are released from an upper position where the book is in use to a lower position where the book is stored, and the biasing means being adapted to bias said pivot member toward said closed position, the force with which the biasing means engages the pivot member being proportional to the mass of the book attached to the cover, the book and the cover being accelerated to the stored lower position by gravity as the cover fails guided by the mounting means.

2. A book cover comprising a cover having a spine and a retainer for attaching a book to the cover;

mounting means for securing the cover by the spine to a fixed structure, the mounting means being disposed on at least one axis transverse to a plane containing said spine and the cover being relatively movable to said mounting means on one said transverse axis between an upper position and a lower position; and self closing means comprising a housing coupled to the cover, and a bail assembly attached to the mounting means, the bail assembly including a pair of bail members each of which is disposed on opposite sides of the cover and pivotable between a closed position associated with the cover in a closed configuration and an open position angularly spaced from the closed position with the cover in an open configuration, the bail assembly being disposed between the cover and the housing, and said housing being adapted to engage the bail assembly and to bias the bail members to pivot toward said closed position upon the book cover assembly being released from an upper position where the book is in use to a lower position where the book is stored, the force with which the housing engages the bail members being proportional to the mass of the book attached to the cover, the book and the cover being accelerated to the stored lower position by...gravity as the covers falls guided by the mounting means.

3. Self closing means for a book cover assembly according to claim 2 in which the mounting assembly includes at least one post coupled to the bail assembly and the housing is apertured to receive the post therethrough and allow relative sliding movement between the housing and the mounting assembly.

4. A book cover assembly comprising a cover having a spine and a retainer for attaching a book to the cover;

mounting means for securing the cover by the spine to a fixed structure, the mounting means being disposed on at least one axis transverse to a plane containing said spine and the cover being relatively movable to said mounting means on one said transverse axis between an upper position and a lower position and self closing means comprising a housing coupled to the cover, and a bail assembly attached to the mounting means, the bail assembly comprising a bar disposed to lie over the spine of the cover and a pair of bail members each comprising a pair of rods having ends pivotally received in the bar, the bail members being disposed on opposite sides of the cover and pivotable between a closed position associated with the cover in a closed configuration and an open position angularly spaced from the closed position with the cover in an open configuration, the bail assembly being disposed between the cover and the housing, and said housing being adapted to engage the bail assembly and to bias the bail members to pivot toward said closed position upon the book cover assembly being released from an .upper position where the book is in use to a lower position where the book is stored, the force with which the housing engages the bail members being proportional to the mass of the book attached to the cover, the book and the cover being accelerated to the stored lower position by gravity as the cover fails guided by the mounting means.

5. Self closing means for a book cover assembly according to claim 4 in which the housing has side walls with a height commensurate with the vertical distance travelled by the housing between said upper and lower positions and adapted to keep the bar hidden from view.

6. Self closing means for a book cover assembly according to claim 5 in which the side walls of the housing have downwardly opening slots which accommodate the bail members.

7. Self closing means for a book cover according to claim 6 in which the height of the side walls above the slots is selected to keep the housing spaced from the bar.

8. Book cover assembly comprising a cover having a spine and a retainer for attached a book to the cover;

mounting means for securing the cover by the spine to a fixed structure, the cover being relatively movable to said mounting means;

and self closing means comprising at least one pivot member defined by a rib integrally molded with the cover and pivotable between a closed position associated with the cover in a closed configuration and an open position angularly spaced from the closed position with the cover in an open configuration, the pivot member being disposed to lie over the spine in said second position;

and biasing means defined by a bar lying in the path of movement of said pivot member and associated with the mounting means so as to engage said pivot member upon relative movement between the cover and the mounting means as the book cover assembly is released from an upper position where the book is in use to a lower position where the book is stored and to bias said pivot member toward said closed position, the force with which the biasing means engages the pivot member being proportional to the mass of the book attached to the cover the book and the cover being accelerated to the stored lower position by gravity as the cover fails guided by the mounting means.

9. Book cover assembly according to claim 8 having two pairs of oppositely disposed ribs longitudinally spaced along the spine of the cover.

10. Book cover assembly according to claim 9 having a housing disposed over the spine and accommodating said biasing means, the cover being hinged to the housing band the housing having openings adapted to receive said ribs so as to allow the ribs to penetrate the housing upon deployment of the cover to an open configuration.

* * * * *